US005334943A

United States Patent [19]

Sawada

[11] Patent Number: 5,334,943

[45] Date of Patent: Aug. 2, 1994

[54] LINEAR ACCELERATOR OPERABLE IN TE 11N MODE

[75] Inventor: Kenji Sawada, Ehime, Japan

[73] Assignee: Sumitomo Heavy Industries, Ltd., Tokyo, Japan

[21] Appl. No.: 885,641

[22] Filed: May 19, 1992

[30] Foreign Application Priority Data

May 20, 1991 [JP] Japan ..... 3-142768
Jul. 1, 1991 [JP] Japan ..... 3-185763

[51] Int. Cl.[5] ..... H01J 23/00

[52] U.S. Cl. ..... 328/233; 313/359.1; 315/5.41; 250/396 R

[58] Field of Search ..... 313/233, 234, 235, 237, 313/62, 359.1; 315/248, 5.41, 39, 5.42; 331/94.1, 3; 250/396 R

[56] References Cited

U.S. PATENT DOCUMENTS 4,490,648 12/1984 Lancaster et al. ..... 328/233 X
4,992,744 2/1991 Fujita et al. ..... 328/233

FOREIGN PATENT DOCUMENTS 0220400 9/1989 Japan ..... 328/233

*Primary Examiner*—Donald J. Yusko
*Assistant Examiner*—Ashok Patel
*Attorney, Agent, or Firm*—Burns, Doane, Swecker & Mathis

[57] ABSTRACT

In a linear accelerator which accelerates a beam of charged particles along a beam axis and which comprises a conductive cylinder defining a hollow space, first through fourth conductive vanes are arranged clockwise in the hollow space around the beam axis with an azimuthal interval of 90° left between two adjacent ones of the vanes and are electrically connected to the conductive cylinder so as to be excited by a $TE_{11N}$ mode on supply of electric power to the conductive cylinder and to induce a quadrupole electric field among the first through the fourth conductive vanes where N is one of 0, 1, 2, . . . . In the $TE_{11N}$ mode, (N+1) sets of excitation members are arranged each of which is composed of first and second conductive plates opposite to each other and projected towards the beam axis, a first intermediate conductive member connected to two of the first through the fourth conductive vanes, and a second intermediate conductive member connected to the remaining conductive vanes.

6 Claims, 7 Drawing Sheets

LINEAR ACCELERATOR OPERABLE IN TE 11N MODE

BACKGROUND OF THE INVENTION

This invention relates to a linear accelerator for use in linearly accelerating a beam of charged particles along a beam axis.

Heretofore, a wide variety of linear accelerators have been proposed so as to linearly accelerate a beam of charged particles, such as ions and electrons along a beam axis and may include, for example, an Alvarez type, a Wideroe type. They are simply and collectively called linac's. A radio frequency quadrupole linac is also included in such linear accelerators and is often abbreviated to an RFQ linear accelerator or an RFQ Linac.

In a conventional RFQ linear accelerator of the type described, the beam of charged particles is linearly accelerated and converged therein along a beam axis by the use of a quadrupole electric field. To this end, the RFQ linear accelerator comprises a conductive cylinder which surrounds a hollow space and has a cylinder axis coincident with the beam axis and a pair of ends having apertures positioned on the beam axis. In addition, first through fourth conductive vanes are arranged in the hollow space around the beam axis with an azimuthal angle of 90° left between adjacent ones of the first through the fourth conductive vanes. These conductive vanes are extended along the beam axis and electrically connected to the conductive cylinder. A combination of the conductive cylinder and the conductive vanes may be referred to as a cavity resonator and is excited by an excitation device of a high frequency radio wave.

With this structure, it is possible to generate the quadrupole electric field around the beam axis and to linearly accelerate and converge the beam along the beam axis, as mentioned above.

More specifically, such a cavity resonator has a resonance mode of $TE_{210}$ and is put into a resonant state when electric power which has a radio frequency equal to a resonance frequency of the $TE_{210}$ mode is given from the excitation device. In this event, the quadrupole electric field is generated around the beam axis in the space gap among the vanes and is operable to linearly accelerate the beam.

However, the quadrupole electric field should be generated with a good symmetry around the beam axis and a good uniformity along the beam axis, and, otherwise, linear acceleration can not be accomplished. This means that inner edges of the conductive vanes must be accurately located at proper positions in the conductive cylinder. In other words, the conductive vanes should be strictly attached to the conductive cylinder and their locations should be finely adjusted.

In order to accomplish a uniform and good symmetrical quadrupole electric field, it is often pointed out that electric field tuning is effective. Such electric field tuning is made by the use of a plurality of electric field tuning devices which are projected into spaces partitioned by the conductive vanes and which are composed of metallic pieces. Specifically, a projected portion of each electric field tuning device is often varied in height to adjust the quadrupole electric field. Such electric field tuning devices make the linear accelerator intricate in structure. In addition, adjustment becomes troublesome for the linear accelerator.

Furthermore, various kinds of modes, such as $TE_{11N}$ modes, may also be induced within the space gap except the resonance mode of $TE_{210}$ and have resonance frequencies somewhat different from and close to that of the resonance mode $TE_{210}$. The quadrupole electric field is seriously disturbed as the resonance frequency of the resonance mode $TE_{210}$ approaches the resonance frequencies of $TE_{11N}$ modes. In this connection, the resonance frequency of the resonance mode $TE_{210}$ should be remote from the other resonance frequencies of $TE_{11N}$. However, each resonance frequency of the above-mentioned modes is uniquely determined by a diameter and a length of a cavity. Therefore, inconvenience is caused to occur in that the length of the cavity can not be freely selected in the conventional linear accelerator.

SUMMARY OF THE INVENTION

It is an object of this invention to provide a linear accelerator which is capable of readily generating a quadrupole electric field which has good symmetry and uniformity.

It is another object of this invention to provide a linear accelerator of the type described, wherein any other resonance modes are not mixed with an optimum mode.

It is still another object of this invention to provide a linear accelerator of the type described, wherein a length of a cavity can freely be selected.

It is yet another object of this invention to provide a linear accelerator of the type described, which is capable of accelerating a beam of charged particles of comparatively high energy.

A linear accelerator to which this invention is applicable is for use in linearly accelerating a beam of charged particles along a beam axis by generating a quadrupole electric field along the beam axis. According to this invention, the linear accelerator comprises a conductive cylinder which surrounds a hollow space and which has a cylinder axis parallel to the beam axis and a pair of ends having apertures positioned on the beam axis, first through fourth conductive vanes azimuthally located clockwise around the cylinder axis with an azimuthal space of a right angle left between two adjacent ones of the conductive vanes so that the first and the third conductive vanes are opposed to each other with the beam axis interposed therebetween while the second and the fourth conductive vanes are also opposed to each other with the beam axis interposed therebetween. The first through the fourth conductive vanes are extended between the ends of the conductive cylinder with a space gap left among the first through the fourth conductive vanes. The linear accelerator further comprises exciting means connected to the conductive cylinder for exciting the first through the fourth conductive vanes by a predetermined mode of $TE_{11N}$ to induce the quadrupole electric field within the space gap where N is an integer.

DESCRIPTION OF THE PREFERRED EMBODIMENTS

Figure 1:
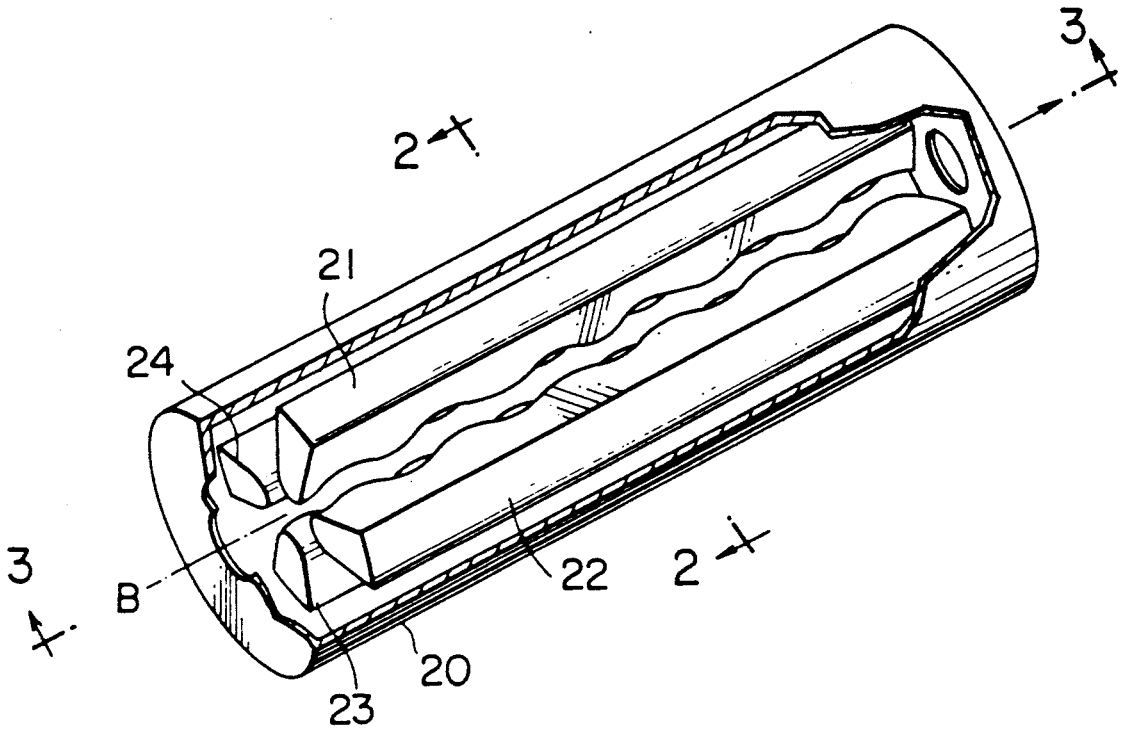
PRIOR ART FIG. 1
FIG. 1 shows a perspective view of a conventional RFQ linear accelerator with a part cut away.
Figure 2:
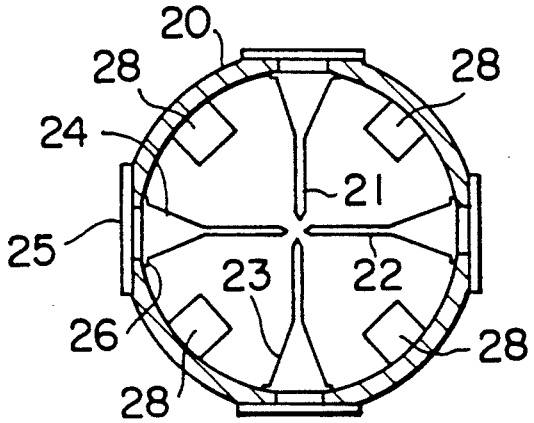
PRIOR ART FIG. 2
FIG. 2 shows a sectional view taken along a line 2—2 of FIG. 1.
Figure 3:
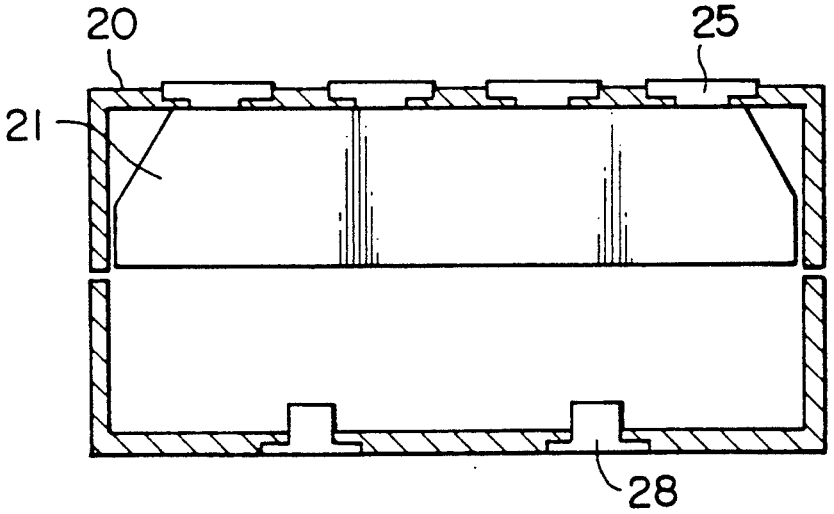
PRIOR ART FIG. 3
FIG. 3 shows an axial sectional view taken along a line 3—3 of FIG. 1.

Referring to FIGS. 1 through 3, description will be made about a conventional RFQ linear accelerator for a better understanding of this invention. In FIGS. 1 to 3, the illustrated linear accelerator is operable to accelerate a beam of charged particles, for example, ions along a beam axis depicted at B in FIG. 1. The linear accelerator comprises a conductive cylinder 20 which has a cylinder axis coincident with the beam axis B, a cylindrical wall defining a hollow space therein, and a pair of ends having apertures positioned on the beam axis. Such apertures serve to allow the beam to pass therethrough.

In FIG. 1, first through fourth conductive vanes 21 to 24 are arranged within the hollow space around the beam axis. As best shown in FIG. 2, an azimuthal interval of 90° is left between two adjacent ones of the conductive vanes 21 to 24 which are numbered clockwise. Each of the conductive vanes 21 to 24 has an inner edge adjacent to the beam axis and an outer edge remote from the beam axis. As illustrated in FIGS. 2 and 3, the outer edges of the conductive vanes 21 to 24 are connected to the cylindrical wall of the conductive cylinder 20 while the inner edges are extended along the beam axis with a space gap remaining among the conductive vanes 21 to 24, as illustrated in FIG. 1. In addition, each inner edge of the conductive vanes 21 to 24 has a corrugated portion to accelerate the beam. A combination of the conductive cylinder 20 and the conductive vanes 21 to 24 forms a cavity resonator.

More specifically, the conductive vanes 21 to 24 are fixed at the outer edges to the conductive cylinder 20 by a plug portion 25 through a contact portion 26, as illustrated in FIG. 2. Thus, each conductive vane 21 to 24 is electrically connected to the conductive cylinder 20. Electric field tuning devices 28 are mounted on the cylindrical wall of the conductive cylinder 20 within each axial spacing partitioned by two adjacent ones of the conductive vanes 21 to 24, as shown in FIG. 2. Each of the electric field tuning devices 28 is helpful to improve symmetry of a quadrupole electric field generated in a manner to be mentioned later and to make the quadrupole electric field uniform along the beam axis B.

Although not shown in FIGS. 1 through 3, the conductive cylinder 20 is connected to a radio frequency power source which generates electric power of a radio frequency. Consequently, a $TE_{210}$ resonance mode of the illustrated cavity resonator is excited by the radio frequency power so as to induce the quadrupole electric field within the space gap among the conductive vanes 21 to 24.

With this structure, when the radio frequency power of which frequency is equal to that of $TE_{210}$ mode of the cavity resonator is supplied to the cavity resonator, the $TE_{210}$ mode of the cavity resonator is excited while a radio frequency current is caused to flow through each conductive vane 21 to 24 in a direction perpendicular to the beam axis B. It is to be noted here that phases of the high frequency currents are inverted to each other in two adjacent ones of the conductive vanes 21 to 24. In other words, a phase difference between the high frequency currents flowing through the two adjacent conductive vanes is equal to 180°. This shows that the two adjacent conductive vanes are supplied with radio frequency voltages which are different from each other by 180°. As a result, the quadrupole electric field is generated or induced in the space gap among the conductive vanes 21 to 24 as an acceleration and convergence electric field.

Herein, various kinds of spontaneous resonance modes are present in the cavity resonator in addition to the $TE_{210}$ mode and have resonance frequencies slightly different from that of the $TE_{210}$ mode. For example, such spontaneous resonance modes may be $TE_{21N}$ modes (where $N=1, 2, 3, \ldots$) and $TE_{11N}$ modes (where $N=0, 1, 2, \ldots$).

It is pointed out that a dipole electric field is often mixed with the quadrupole electric field and disturbs distribution of the quadrupole electric field when the resonance frequency of the $TE_{210}$ mode is extremely close to that of a lower order of the $TE_{11N}$ modes. This brings about a reduction of performance for acceleration of the illustrated linear accelerator. Therefore, the resonance frequency of the $TE_{210}$ mode should be sufficiently remote from those of the $TE_{11N}$ modes. However, it is practically difficult to effectively separate the resonance frequency of the $TE_{210}$ mode from those of the $TE_{11N}$ modes because these resonance frequencies are uniquely determined by a diameter and a length of the conductive cylinder 20.

Moreover, the conductive vanes 21 to 24 should be located at accurate positions in order to generate the quadrupole electric field which has a good symmetric property. At any rate, the quadrupole electric field should be finely adjusted by the use of the electric field tuning devices 28, as mentioned in the preamble of the instant specification.

Figure 4:
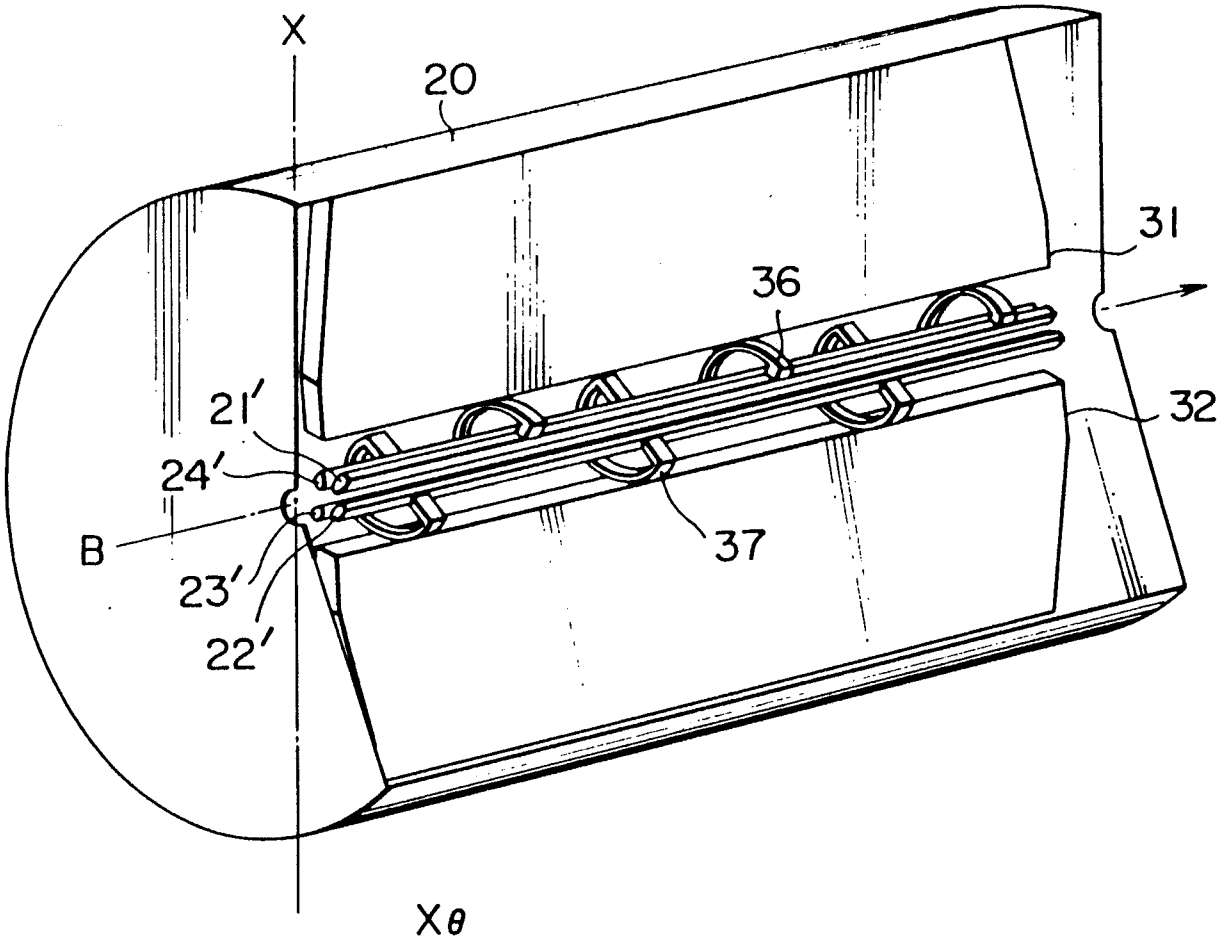
FIG. 4 shows a perspective view of a linear accelerator according to a first embodiment of this invention with a part cut away.
Figure 5:
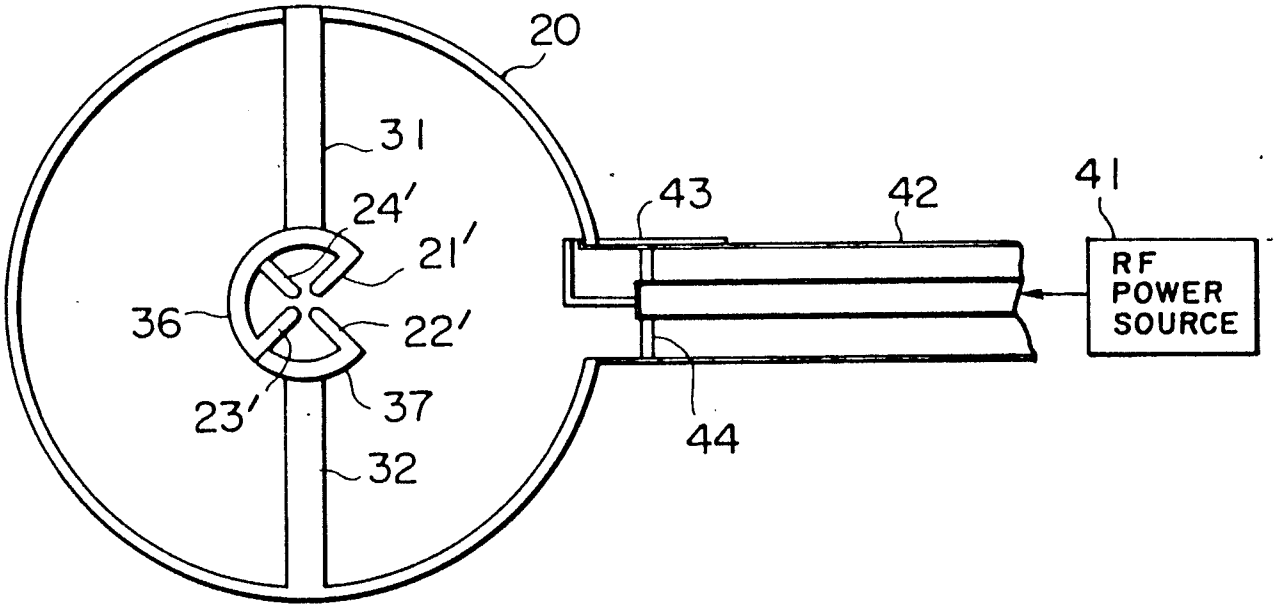
FIG. 5 shows another sectional view of the linear accelerator illustrated in FIG. 4.

Referring to FIGS. 4 through 7, a linear accelerator according to a first embodiment of this invention is applicable to a RFQ linac like in FIGS. 1 through 3 and comprises a conductive cylinder 20 and first through fourth conductive vanes 21' to 24' which are arranged around and extended along the beam axis, like in FIGS. 1 through 3. As illustrated in FIGS. 4 and 5, the first through the fourth conductive vanes 21' to 24' are azimuthally spaced around the beam axis B with an azimuthal space of 90° left between two adjacent ones of the first through the fourth conductive vanes 21' to 24'. In this connection, the first and the third conductive vanes 21' and 23' are opposed to each other with the cylinder axis interposed therebetween. Likewise, the second and the fourth conductive vanes 22' and 24' are also opposed to each other with the cylinder axis interposed therebetween. A space gap is axially defined among the conductive vanes 21' to 24' to accelerate the beam therein and therefore includes the beam axis.

In FIG. 4, the illustrated linear accelerator comprises first and second conductive plates 31 and 32 which are opposed to each other in the hollow space and which have outer edges attached to the conductive cylinder 20 and inner edges adjacent to the beam axis. In any event, the first and the second conductive plates 31 and 32 are extended from the conductive cylinder 20 towards the cylinder axis in no contact with the conductive vanes 21' to 24' and are azimuthally spaced apart from each other by 180°.

It is to be noted that each of the first and the second conductive plates 31 and 32 consists of a single conductive plate so that a resonance mode becomes a $TE_{110}$ mode, as will become clear as the description proceeds.

For convenience of description, the first and the third conductive vanes 21' and 23' will often be called a first set of the conductive vanes while the second and the fourth conductive vanes 22' and 24' will be called a second set of the conductive vanes. In the example being illustrated, the first set of the conductive vanes 21' and 23' are connected to the first conductive plate 31 by a first set of intermediate conductive members 36. On the other hand, the second set of the conductive vanes 22' and 24' are connected to the second conductive plate 32 by a second set of intermediate conductive members 37. Each of the first and the second sets is composed of three intermediate conductive members which are similar in structure to one another. Specifically, each intermediate conductive member 36 and 37 has a semicircular configuration in section, as illustrated in FIG. 4. Thus, the first conductive plate 31 and the first set of the conductive vanes 21' and 23' are electrically shorted to each other through the first set of the intermediate conductive members 36 while the second conductive plate 32 and the second set of the conductive vanes 22' and 24' are also electrically shorted to each other through the second set of the intermediate conductive members 37. In FIG. 4, the first and the second set of the intermediate conductive members 36 and 37 are alternately arranged along the beam axis so as to generate the quadrupole electric field.

Taking the above into consideration, a combination of the conductive cylinder 20, the first and the second conductive plates 31 and 32, the first and the second sets of the intermediate conductive members 36 and 37, and the first through the fourth conductive vanes 21' to 24' forms a cavity resonator. Similarly, the first and the second conductive plates 31 and 32, the first and the second sets of the intermediate conductive members 36 and 37, and the first through the fourth conductive vanes 21' to 24' are effective to generate the quadrupole electric field and may therefore be collectively referred to as an electric field generating member. Among others, the first and the second conductive plates 31 and 32 and the first and the second sets of the intermediate conductive members 36 and 37 serve to excite the conductive vanes 21' to 24' and to induce the quadrupole electric field within the space gap among the conductive vanes 21' to 24'. Accordingly, a combination of the first and the second conductive plates 31 and 32 and the first and the second sets of the intermediate conductive members 36 and 37 may be called an exciting member for exciting the conductive vanes 21' to 24'.

In FIG. 5, a radio frequency power supply member comprises a radio frequency (RF) power source 41 for generating electric power of a radio frequency, a transmission line 42 formed by a coaxial wave guide, and a matching circuit 43 which may be called a loop coupler. The loop coupler is attached to an end of the transmission line 42 through a ceramic window 44 and is electrically connected to the transmission line 42 and the conductive cylinder 20. Thus, the radio frequency power is supplied from the RF power source 41 to the cavity resonator.

With this structure, the $TE_{110}$ resonance mode of the cavity resonator is excited when the radio frequency power of which frequency is equal to that of the $TE_{110}$ mode is supplied to the cavity resonator, as mentioned before. Inasmuch as the first set of the conductive vanes 21' and 23' is electrically shorted each other through the first set of the intermediate conductive members 36, the first and the third conductive vanes 21' and 23' of the first set are supplied with radio frequency voltages which have an identical or normal polarity and which are named normal polarity voltages. Likewise, the second set of the conductive vanes 22' and 24' is electrically shorted each other through the second set of the intermediate conductive members 37 and is given radio frequency voltages which have the same polarity inverse to the normal polarity and which may be called inverse polarity voltages.

The first set of the conductive vanes 21' and 23' and the second set of the conductive vanes 22' and 24' are driven by the normal and the inverse polarity voltages which take the same absolute value, respectively. A relationship between the normal and the inverse polarities is reversed at every half period of a resonance frequency. As a result, the quadrupole electric field is induced within the space gap among the conductive vanes 21' to 24'.

Figure 6:
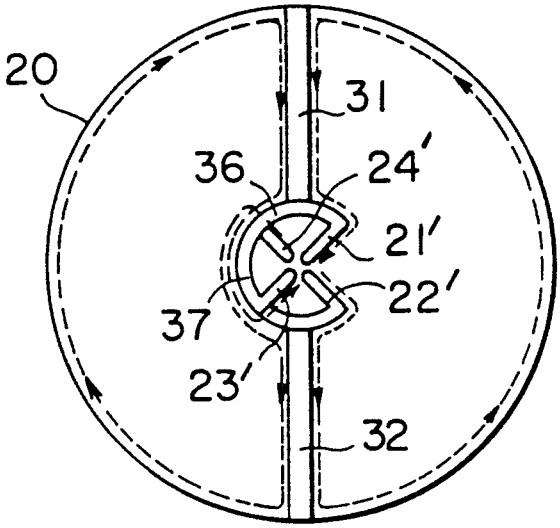
FIG. 6 shows a sectional view for use in describing operation of the linear accelerator illustrated in FIG. 4.
Figure 7:
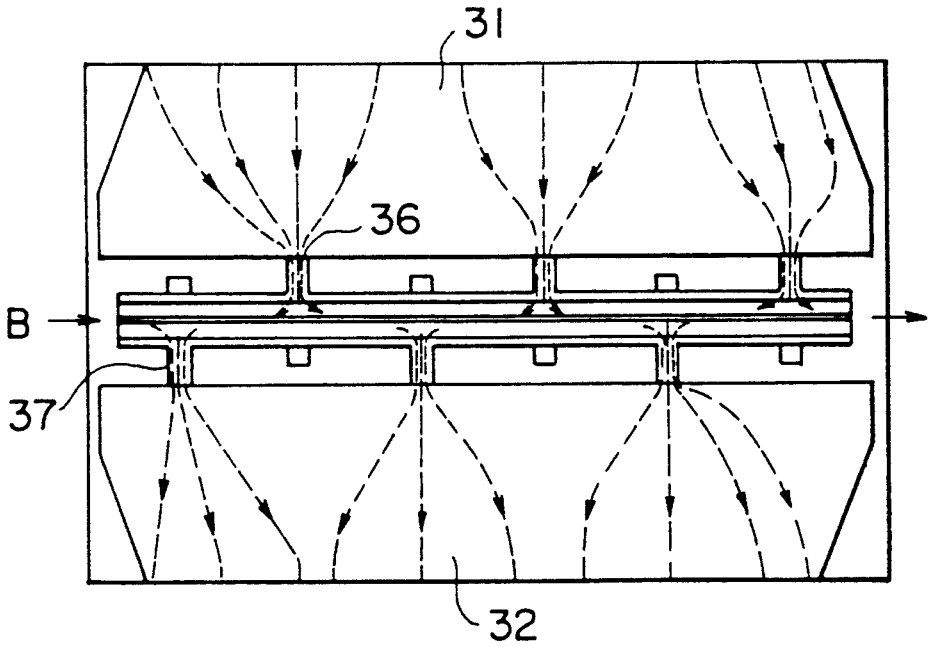
FIG. 7 shows an axial sectional view for use in describing operation of the linear accelerator illustrated in FIG. 4.

In FIG. 6, radio frequency currents are caused to flow through the cavity resonator by excitation of the resonance mode of $TE_{110}$, as specified by electric flux lines (depicted at broken lines in FIGS. 6 and 7). More particularly, the radio frequency current is caused to flow for a certain half period of the resonance frequency from the conductive cylinder 20 to the first and the third conductive vanes 21' and 23' through the first conductive plate 31 and the first set of the intermediate conductive members 36, as shown in FIGS. 6 and 7. Thereafter, the radio frequency current is caused to flow through the second and the fourth conductive vanes 22' and 24', the second set of the intermediate conductive members 37, and the second conductive plate 32 to the conductive cylinder 20. Thus, the radio frequency current is fed back to the conductive cylinder 20 and is caused to symmetrically flow along the conductive cylinder 20, as illustrated in FIG. 6. In addition, the radio frequency current is caused to flow from the first conductive plate 31 to the second conductive plate through the intermediate conductive members 36 and the conductive vanes, as shown in FIG. 7.

From FIGS. 6 and 7, it is readily understood that the quadrupole electric field is generated among the conductive vanes 21' to 24'. The states illustrated in FIGS. 6 and 7 are inverted at every half period of the resonance frequency. This shows that the illustrated linear accelerator forms an RFQ linac using the resonance mode of $TE_{110}$ and can generate an electric field which is similar to that appearing when the $TE_{210}$ mode is used. Accordingly, the beam of the charged particles is accelerated and converged along the beam axis B in a manner similar to that illustrated in FIGS. 1 through 3.

Such use of the $TE_{110}$ mode enables a reduction of size of the conductive vanes. This means that the conductive vanes can be accurately mounted on the conductive cylinder.

Inasmuch as the $TE_{110}$ mode is the lowest order mode of the cavity resonator, no disturbance of the electric field takes place due to a close relationship between resonance frequencies of the other modes. Therefore, it is possible to optionally select a diameter of a conductive cylinder and a length of conductive vanes. Moreover, a symmetrical quadrupole electric field is always generated because opposite conductive vanes are always kept at the same potential. This dispenses with necessity of the electric field tuning devices, such as 28 illustrated in FIGS. 2 and 3.

Figure 8:
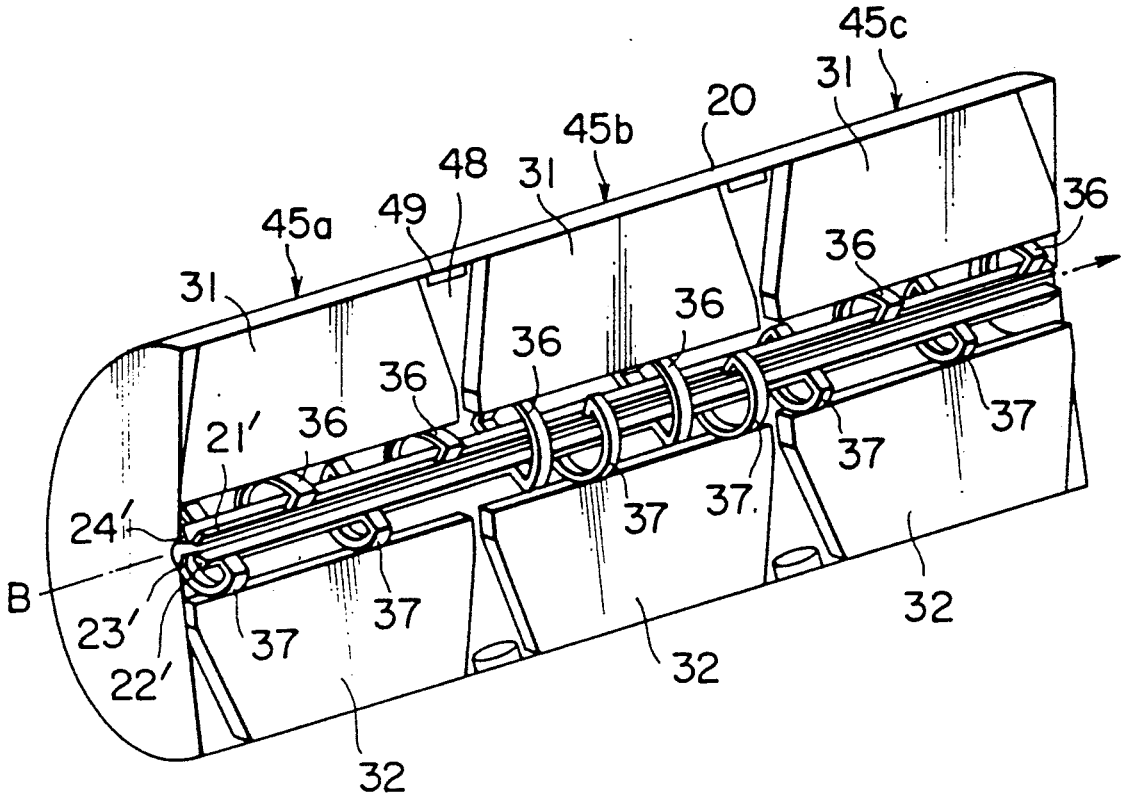
FIG. 8 shows a perspective view of a linear accelerator according to a second embodiment of this invention with a part cut away.

Referring to FIG. 8, a linear accelerator according to a second embodiment of this invention is effective to prevent disturbance of a quadrupole electric field even when a conductive cylinder 20 becomes long. In the example being illustrated, the linear accelerator comprises a conductive cylinder 20 and first through fourth conductive vanes 21' to 24' which are arranged around a beam axis B and which are extended between both ends of the conductive ends at which apertures are opened on the beam axis B, like in FIG. 4.

Herein, it is assumed that the illustrated accelerator is excited by a resonance mode of $TE_{112}$. Taking this into consideration, first through third sets of conductive plates are located within the hollow space of the conductive cylinder 20 and are depicted at 45*a*, 45*b*, and 45*c*. Each set of the conductive plates is composed of first and second conductive plates 31 and 32 which are located on upper and lower sides of FIG. 8, respectively, and which are extended from the conductive cylinder 20 towards the beam axis. At any event, the first and the second conductive plates 31 and 32 of each set are opposed to each other. The first through the fourth conductive vanes 21' to 24' are interposed and extended between the first and the second conductive plates 31 and 32 of the first through the third set. The first conductive plates 31 of the first through the third sets 45*a*, 45*b*, and 45*c* are aligned with one another and the second conductive plates 32 of the first through the third sets 45*a* to 45*c* are also aligned with one another.

Between the first conductive plate 31 of the first set 45*a* and the first and the third conductive vanes 21' and 23', two of the first intermediate conductive members are interposed to electrically connect the first conductive plate 31 to the first and the third conductive vanes 21' and 23' and are axially spaced apart from each other. Likewise, two of the second intermediate conductive members 37 are interposed between the second conductive plate 32 of the first set 45*a* and the second and the fourth conductive vanes 22' and 24' to electrically connect the second conductive plate 37 to the second and the fourth conductive vanes 22' and 24'. The first and the second intermediate conductive members 36 and 37 are alternately arranged along the cylinder axis with space intervals remaining among them. The number of each of the first and the second intermediate conductive members 36 and 37 may not be restricted to two but may be equal to unity or three. In addition, the first and the second intermediate conductive members 36 and 37 may not always be alternately arranged along the beam axis.

Herein, it is to be noted that the intermediate conductive members 36 which are connected to the first conductive plate 31 may be called first intermediate conductive members while the intermediate conductive members 37 which are connected to the second conductive plate 32 may be called second intermediate conductive members.

As shown in FIG. 8, the first conductive plate 31 of the second set 45*b* is electrically connected to the second and the fourth conductive vanes 22' and 24' through two of the first intermediate conductive members 36 while the second conductive plate 32 of the second set 45*b* is electrically connected to the first and the third conductive vanes 21' and 23' through two of the second intermediate conductive members 37. In the illustrated example, the first and the second intermediate conductive members 36 and 37 are alternately arranged along the beam axis.

Furthermore, the first conductive plate 31 of the third set 45*c* is connected to the first and the third conductive vanes 21' and 23' through two of the first intermediate conductive members 36 while the second conductive plate 32 of the third set 45*c* is connected to the second and the fourth conductive vanes 22' and 24' through two of the second intermediate conductive members 37, like the first and the second conductive plates 31 and 32 of the first set 45*a*.

From this fact, it is understood that the first intermediate conductive members 36 of a certain one of the first through the third sets 45*a* to 45*c* are connected to a selected set of the first and the third conductive vanes 21' and 23' and the second and the fourth conductive vanes 22' and 24' while the first intermediate conductive members 36 of an adjacent one of the certain set are connected to a remaining set of the first and the third conductive vanes 21' and 23' and the second and the fourth conductive vanes 22' and 24'. Thus, alternate connections between the first and the second conductive plates 31 and 32 and the first and the second sets of the conductive vanes may be made so as to be excited by the resonance mode of $TE_{112}$. This means that three sets of the first and the second conductive plates 31 and 32 may be arranged to obtain the $TE_{112}$ mode and that first through $(N+1)$-th sets of the first through the second conductive plates 31 and 32 may be arranged within the conductive cylinder 20 to obtain the $TE_{11N}$ mode.

Each set 45*a* to 45*c* of the first and the second conductive plates 31 and 32 forms a resonance cell together with the conductive vanes and the intermediate conductive members 36 and 37.

As illustrated in FIG. 8, spacings 48 are left between two adjacent ones of the first through the third sets 45*a* to 45*c* each of which is composed of the first and the second conductive plates 31 and 32. Within the spacings 48, adjustment elements 49 which may be, for example, electric field tuning devices are located to adjust electric fields.

The linear accelerator illustrated in FIG. 8 is driven by a radio frequency power supply member, as shown in FIG. 5, although not shown in FIG. 8.

Figure 9:
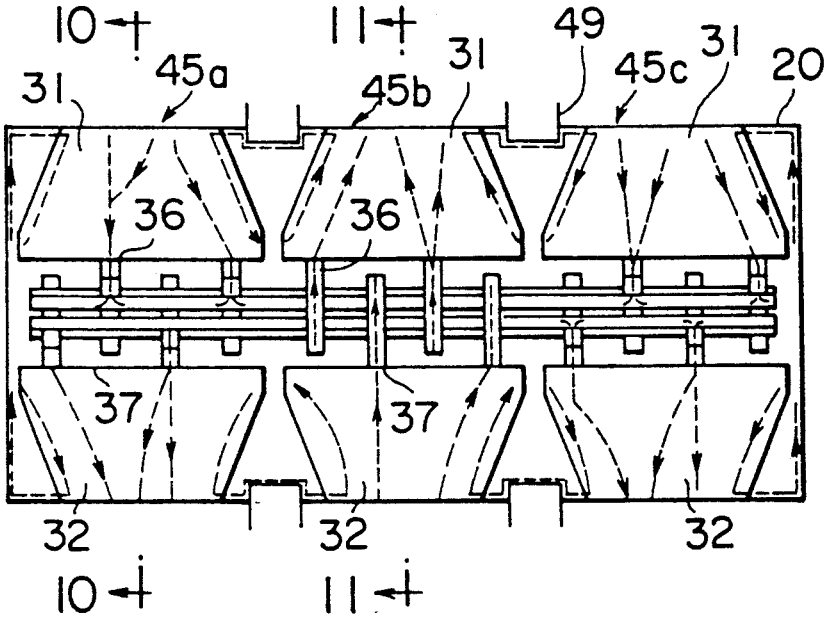
FIG. 9 shows an axial sectional view for use in describing operation of the linear accelerator illustrated in FIG. 8.
Figure 10:
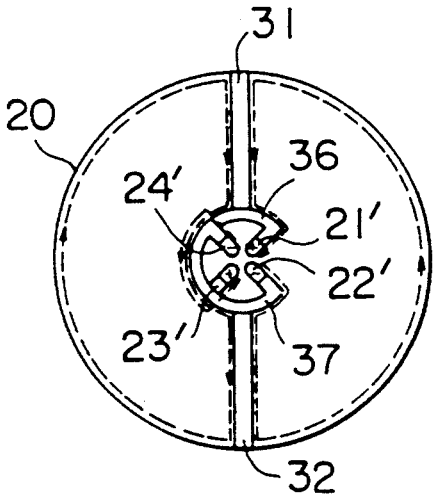
FIG. 10 shows a sectional view taken along a line 10—10 in FIG. 9.
Figure 11:
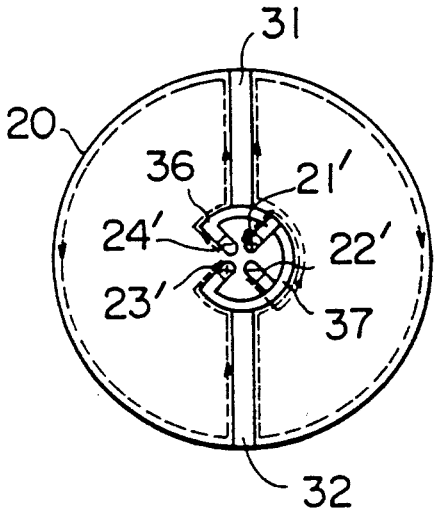
FIG. 11 shows a similar view taken along a line 11—11 in FIG. 9.

Referring to FIGS. 9 through 11, a radio frequency current is caused to flow in the illustrated manner when the linear accelerator is supplied from the electric power supply member with electric power in the manner described in conjunction with FIG. 5 and is excited by the $TE_{112}$ mode. The radio frequency power is given in the form of an electric voltage of a radio frequency and an electric current which will be called a radio frequency voltage and a radio frequency current, respectively.

For brevity of description, the resonance cell which includes the first set 45*a* of the first and the second conductive plates 31 and 32 may be referred to as a first resonance cell while the resonance cells which include the second and the third sets 45*b* and 45*c* of the first and the second conductive plates 31 and 32 may be referred to as second and third resonance cells, respectively.

As shown in FIGS. 9 and 10, the radio frequency current is caused to flow from the first conductive plate 31 to the second conductive plate 32 through the first and the second intermediate conductive members 36 and 37 in the first resonance cell within a certain half period of the radio frequency voltage, as mentioned with reference to FIGS. 6 and 7. In this case, two adjacent ones of the first through the fourth conductive vanes 21' to 24' are given electric voltages which have inverse polarities relative to each other, as illustrated in FIG. 10. Consequently, a quadrupole electric field is generated in the space gap among the first through the fourth conductive vanes 21' to 24'.

On the other hand, the connections between the conductive vanes 21' to 24' and the conductive plates 31 and 32 are reversed by the intermediate conductive members 36 and 37 in the second resonance cell relative to the first resonance cell. Therefore, the radio frequency current is caused to flow in the second resonance cell from the second conductive plate 31 to the second conductive plate 32 in a manner illustrated in FIGS. 9 and 11. Such a radio frequency current gives an electric voltage to the conductive vanes 21' to 24' in the second resonance cell. The electric voltage among the conductive vanes 21' to 24' in the second resonance cell is identical with the electric voltage in the first resonance cell, as illustrated in FIGS. 10 and 11. Thus, the quadrupole electric field is also generated in the second resonance cell.

In the third resonance cell, the radio frequency current is caused to flow in a manner similar to that illustrated in conjunction with the first resonance cell. This shows that the electric voltage is supplied to the conductive vanes 21' to 24' and has the same polarity as the electric voltages given to the first and the second resonance cells and that the quadrupole electric field is also generated in the space gap among the conductive vanes 21' to 24'.

As described in conjunction with the linear accelerator illustrated in FIGS. 4 through 7, both the first and the third conductive vanes 21' and 23' are always kept at an identical potential as well as the second and the fourth conductive vanes 22' and 24' and have voltage polarities inverted to those of the second and the fourth conductive vanes 22' and 24'. In addition, an absolute value of the electric potential given to the first and the third conductive vanes 21' and 23' is equal to the absolute value of the electric potential given to the second and the fourth conductive vanes 22' and 24'. Accordingly, the quadrupole electric field has good symmetry with respect to the cylinder axis.

Directions of the radio frequency current and the polarities of the radio frequency voltages illustrated in FIGS. 9 through 11 are inverted at every half period of the radio frequency voltage.

The illustrated linear accelerator has not only advantages as mentioned in conjunction with the conventional linear accelerator excited by the $TE_{110}$ mode but also the following advantages. At first, the illustrated linear accelerator is excited by the $TE_{112}$ mode which has two nodes along the beam axis B and a large group velocity along the beam axis B. This serves to improve stability of the quadrupole electric field along the beam axis B. So it is much easier to make the quadrupole electric field uniform along the beam axis B because radio frequency energy is readily transmitted among the resonance cells even when a load is imposed on the beam. Moreover, it is also much easier to tune or compensate for a frequency of the radio frequency voltage by adjusting the electric field tuning devices 49.

While this invention has thus far been described in conjunction with a few embodiments thereof, it will readily be possible for those skilled in the art to put this invention into practice in various other manners. For example, the linear accelerator may comprise a plurality of resonance cells equal to two or greater than three. In this event, the conductive vanes and the conductive plates must be alternately connected to one another at every one of the resonance cells in the manner mentioned before.

What is claimed is:

1. A linear accelerator for use in linearly accelerating a beam of charged particles along a beam axis, said linear accelerator comprising:

a conductive cylinder surrounding a hollow space and having a cylinder axis parallel to said beam axis and a pair of ends having apertures positioned along said beam axis;

first and second conductive plates extended from said conductive cylinder towards said beam axis with an axial gap interposed between said conductive plates with said beam axis extended through said axial gap;

first through fourth conductive vanes azimuthally located clockwise around said beam axis with an azimuthal space of a right angle left between two adjacent ones of said conductive vanes so that said first and said third conductive vanes are opposed to each other with said beam axis interposed therebetween while said second and said fourth conductive vanes are also opposed to each other with said beam axis interposed therebetween;

a first set of intermediate conductive members which are located with first spacings left therebetween along said beam axis and each of which is connected to said first conductive plate and said first and said third conductive vanes; and a second set of intermediate conductive members which are located with second spacings left therebetween along said beam axis and each of which is connected to said second conductive plate and said second and said fourth conductive vanes; and radio frequency power supply means for supplying electric power of a radio frequency to said first through said fourth conductive vanes through said first and said second conductive plates and said first and said second sets of the intermediate conductive members to excite said first through said fourth conductive vanes to induce a quadrupole electric field among said first through said fourth conductive vanes and to accelerate and focus said beam along said beam axis.

2. A linear accelerator for use in linearly accelerating a beam of charged particles along a beam axis by generating a quadrupole electric field around said beam axis in a cavity resonator, said linear accelerator comprising:

a conductive cylinder surrounding a hollow space and having a cylinder axis parallel to said beam axis and a pair of ends having apertures positioned along said beam axis;

first through fourth conductive vanes azimuthally located clockwise around said beam axis with an azimuthal space of a right angle left between two adjacent ones of said conductive vanes so that said first and said third conductive vanes are opposed to each other with said beam axis interposed therebetween while said second and said fourth conductive vanes are also opposed to each other with said beam axis interposed therebetween;

radio frequency power generating means for generating electric power of a radio frequency;

at least one set of electric field conductive members electrically connected to both of said vanes and said radio frequency power supply means so that said quadrupole electric field is generated within a space gap left among said first through said fourth conductive vanes by exciting said cavity resonator in a predetermined mode of $TE_{11N}$, where N is equal to 0, 1, 2, . . . .

3. A linear accelerator as claimed in claim 2, wherein said N is equal to 0 while at least one set of the electric field conductive members is equal in number to unity.

4. A linear accelerator as claimed in claim 2, wherein said N is greater than unity while at least one set of the electric field conductive members is equal in number to (N+1).

5. A linear accelerator for use in linearly accelerating a beam of charged particles along a beam axis by generating a quadrupole electric field in a cavity resonator along said beam axis, said linear accelerator comprising:

a conductive cylinder which surrounds a hollow space and which has a cylinder axis parallel to said beam axis and a pair of ends having apertures positioned on said beam axis;

first through fourth conductive vanes azimuthally located clockwise around said beam axis with an azimuthal interval of a right angle left between two adjacent ones of said conductive vanes so that said first and said third conductive vanes are opposed to each other with said beam axis interposed therebetween while said second and said fourth conductive vanes are also opposed to each other with said beam axis interposed therebetween, said first through said fourth conductive vanes being extended between said ends of the conductive cylinder with a space gap left among said first through said fourth conductive vanes; and exciting means connected to said cavity resonator for exciting said first through said fourth conductive vanes by a predetermined mode $TE_{110}$ to induce said quadrupole electric field within said space gap;

said exciting means comprising:

first and second conductive plates extended from said conductive cylinder towards said beam axis with said space gap interposed between said conductive plates;

a first intermediate conductive member connected to said first and said third conductive vanes and said first conductive plate;

a second intermediate conductive member connected to said second and said fourth conductive vanes and said second conductive plate; and radio frequency power supply means for supplying electric power of a radio frequency to said first and said second conductive plates, to excite said cavity resonator in the predetermined mode $TE_{110}$, and to thereby induce said quadrupole electric field within said space gap among said first through said fourth conductive vanes.

6. A linear accelerator for use in linearly accelerating a beam of charged particles along a beam axis by generating a quadrupole electric field in a cavity resonator along said beam axis, said linear accelerator comprising:

a conductor cylinder which surrounds a hollow space and which has a cylinder axis parallel to said beam axis and a pair of ends having apertures positioned on said beam axis;

fist through fourth conductive vanes azimuthally located clockwise around said beam axis with an azimuthal interval of a right angle left between two adjacent ones of said conductive vanes so that said first and said third conductive vanes are opposed to each other with said beam axis interposed therebetween while said second and said fourth conductive vanes are also opposed to each other with said beam axis interposed therebetween, said first through said fourth conductive vanes being extended between said ends of the conductive cylinder with a space gap left among said first through said fourth conductive vanes; and exciting means connected to said cavity resonator for exciting said first through said fourth conductive vanes by a predetermined mode $TE_{11N}$ to induce said quadrupole electric field within said space gap where N is an integer greater than zero;

said exciting means comprising:

a preselected number of conductive plate sets each of which is composed of first and second conductive plates extended within said hollow space from said conductive cylinder towards said beam axis and opposed to each other, said preselected number being equal to (N+1), said first conductive plates of each set being aligned with one another along said beam axis while said second conductive plates are also aligned with one another;

first intermediate conductive means for connecting said first and said third conductive vanes to the first conductive plate of a predetermined one of the sets and for connecting said second and said fourth conductive vanes to the first conductive plate of an adjacent set to said predetermined one of the sets; and second intermediate conductive mans for connecting said second and said fourth conductive vanes to the second conductive plate of said predetermined one of the sets and for connecting said first and said third conductive vanes to the first conductive plate of said adjacent set to said predetermined one of the sets.

* * * * *